US010784027B2

(12) United States Patent
Kuan et al.

(10) Patent No.: US 10,784,027 B2
(45) Date of Patent: Sep. 22, 2020

(54) VOLTAGE DEPENDENT RESISTOR

(71) Applicant: Joyin Co., Ltd., Taoyuan (TW)

(72) Inventors: Te-Hua Kuan, Taoyuan (TW); Teng-Hsi Yu, Taoyuan (TW)

(73) Assignee: Joyin Co., Ltd., Taoyuan (TW)

( * ) Notice: Subject to any disclaimer, the term of this patent is extended or adjusted under 35 U.S.C. 154(b) by 0 days.

(21) Appl. No.: 16/678,704

(22) Filed: Nov. 8, 2019

(65) Prior Publication Data

US 2020/0152362 A1 May 14, 2020

(30) Foreign Application Priority Data

Nov. 13, 2018 (TW) ..... 107215421 A

(51) Int. Cl.
*H01C 7/12* (2006.01)
*H01C 1/14* (2006.01)

(52) U.S. Cl.
CPC ..... *H01C 7/12* (2013.01); *H01C 1/14* (2013.01)

(58) Field of Classification Search
CPC ..... H01C 7/12; H01C 1/14
See application file for complete search history.

(56) References Cited

U.S. PATENT DOCUMENTS 3,619,708 A * 11/1971 Stetson ..... H01T 4/20 315/36
3,883,774 A * 5/1975 Volkenau ..... H01T 1/04 315/58
5,939,972 A * 8/1999 Nagao ..... H01C 7/02 338/22 R
2005/0016969 A1* 1/2005 Kessler ..... C04B 41/009 219/121.6
2011/0274831 A1* 11/2011 Saegusa ..... H01C 1/028 427/103
2011/0304946 A1* 12/2011 Koga ..... H01C 7/1006 361/118

* cited by examiner

*Primary Examiner* — Kyung S Lee
(74) *Attorney, Agent, or Firm* — Jackson IPG PLLC; Demian K. Jackson

(57) ABSTRACT

A voltage dependent resistor includes a ceramic body and an electrically conductive structure for external connection. The ceramic body has two opposite surfaces and a side surface connecting the two opposite surfaces, and at least one of the two opposite surfaces is formed with at least one protrusion at a position adjacent to the side surface. As the protrusion makes the opposite surfaces of the ceramic body non-planar, the voltage dependent resistor is capable of suppressing the occurrence of flashover firelight during surge impact, so that its capability of withstanding surge impact is enhanced and its lifespan is prolonged. In addition, such structural arrangement is capable of preventing ceramic plates from adhering with each other when they are stacked with each other during the sintering stage of a green compact, thereby simplifying the post-processing procedures and minimizing the defect rate.

16 Claims, 5 Drawing Sheets

VOLTAGE DEPENDENT RESISTOR

PRIORITY CLAIM

This application claims priority to R.O.C. Patent Application No. 107215421 filed Nov. 13, 2018, the entirety of which is incorporated herein by reference.

FIELD OF THE INVENTION

The present invention relates to a voltage dependent resistor having a prolonged lifespan and having an enhanced capability of suppressing the occurrence of flashover firelight, withstanding high surge impact, and preventing ceramic plates from adhering with each other during the sintering stage.

BACKGROUND OF THE INVENTION

As the surge or transient overvoltage caused by lightning strikes, switching actions or damaged parts would directly disturb or even destroy electronic components or electronic circuits, voltage depedent resistors, also known as varistors, being a surge absorber with excellent surge absorption capability, have been widely applied as a protective component for overvoltage or surge absorption of electronic components or electronic circuits. However, when a conventional voltage dependent resistor encounters an excessively high overvoltage or surge impact or a persistent overvoltage, it will usually cause electronic components to blast instantaneously or the temperature will continue to rise, which can eventually cause electronic components to burn out and result in safety problems.

Conventional surge protection circuits are commonly provided with a voltage dependent resistor. The voltage dependent resistor has superior nonlinear resistance characteristics. In the case where the circuit is subjected to a transient overvoltage or surge, the voltage dependent resistor will act immediately to suppress overvoltage and absorb surge energy to protect electrical equipment and electronic components. If the transient overvoltage or surge is extremely large, overly persistent or occurs frequently, it is bound to cause the voltage dependent resistor to deteriorate in performance or even fail. Furthermore, when the voltage dependent resistor receives excessively high surge or persistent overvoltage, the voltage dependent resistor will quickly break down and even cause a fire. It is important that the voltage dependent resistor's capability of withstanding surge impact should be improved.

At present, in a manufacturing process of a voltage dependent resistor, an additional processing procedure is required to separate an upper ceramic body from a lower ceramic body, which increases the manufacturing costs and time.

SUMMARY OF THE INVENTION

An object of the invention is to provide a voltage dependent resistor having a prolonged lifespan and having an enhanced capability of suppressing the occurrence of flashover firelight, withstanding high surge impact, and preventing ceramic plates from adhering with each other during the sintering stage.

The voltage dependent resistor according to the invention comprises a ceramic body, and an electrically conductive structure electrically connected to the ceramic body and adapted for external connection. The ceramic body comprises two opposite surfaces and a side surface connecting the two surfaces. At least one of the two opposite surfaces is formed with at least one protrusion at a position adjacent to the side surface. As the protrusion makes the two opposite surfaces of the ceramic body non-planar, the voltage dependent resistor's capability of suppressing the occurrence of flashover firelight during surge impact is enhanced, whereby its capability of withstanding surge impact is improved and its lifespan is prolonged. In addition, such structural arrangement is capable of preventing ceramic plates from adhering with each other when they are stacked with each other during the sintering stage of a green compact, thereby simplifying the post-processing procedures and minimizing the defect rate.

In the preferred embodiments, at least one of the two opposite surfaces of the ceramic body is formed with a protrusion configured in an annular closed loop extending along the side surface.

In the preferred embodiments, at least one of the two opposite surfaces of the ceramic body is formed with three protrusions. In more preferred embodiments, the three protrusions are circumferentially and symmetrically distributed on the at least one of the opposite surfaces of the ceramic body and spaced out 120 degrees apart, when the ceramic body is viewed from top.

In the preferred embodiments, the electrically conductive structure comprises a first electrode and a second electrode disposed on the two opposite surfaces, respectively, and a first terminal and a second terminal. The first terminal is disposed at one end thereof on the ceramic body in such manner that it is electrically connected to the first electrode, while the other end of the first terminal extends beyond the ceramic body. The second terminal is disposed at one end thereof on the ceramic body in such manner that it is electrically connected to the second electrode, while the other end of the second terminal extends beyond the ceramic body.

In the preferred embodiments, the voltage dependent resistor further comprises an insulating layer coated outside of the ceramic body, so that the first and second electrodes and the one ends of the first and second terminals are embedded.

In the preferred embodiments, the protrusion has connection surfaces connected to the ceramic body.

In the preferred embodiments, the connection surfaces are independently configured into a form selected from the group consisting of a planar form and an arcuate form.

In the preferred embodiments, the connection surfaces are inclined with respect to the opposite surfaces.

In the preferred embodiments, the connection surfaces are arranged substantially perpendicular to the opposite surfaces.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

In order to facilitate the examiner's understanding of the technical features, content and advantages of the present invention and the efficacies it can achieve, the present invention will be described in detail as follows in the form of embodiments and with reference to the accompanying drawings. The drawings used herein are merely for the purpose of illustration and supplement for the present invention, and may not be the true proportions and precise configurations after the implementation of the present invention. Therefore, relationships between the proportions and configurations of the attached drawings should not be used to interpret or limit the scope of claims in the actual implementation.

Figure 1:
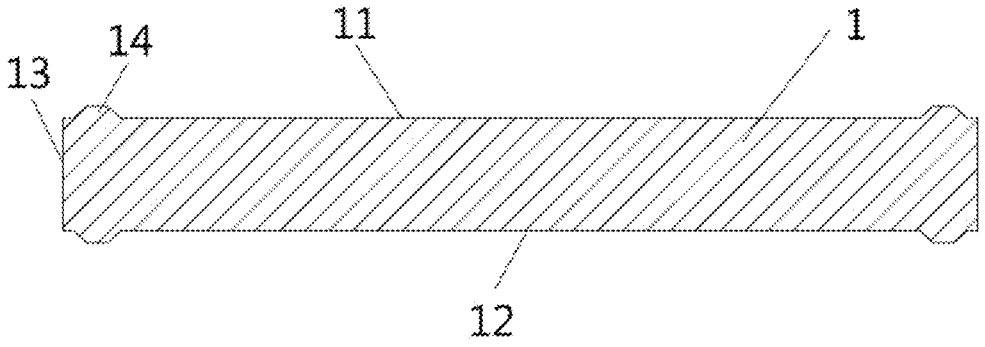
FIG. 1 is a perspective view of a ceramic body according to the first embodiment of the invention.
Figure 2:
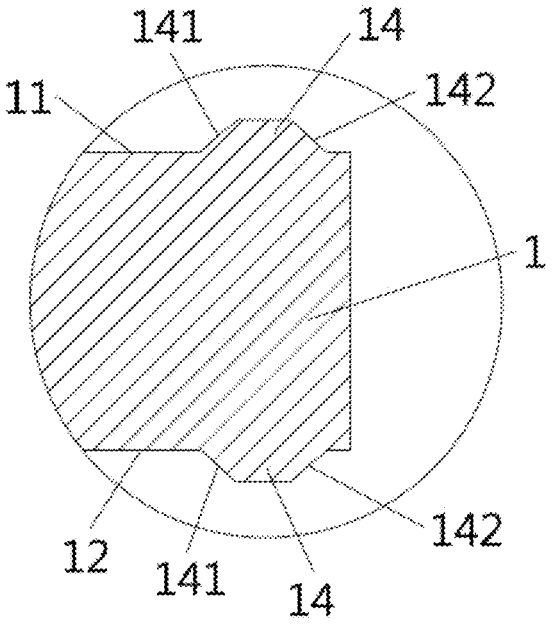
FIG. 2 is a partially enlarged schematic view of the ceramic body according to the first embodiment of the invention.
Figure 3:
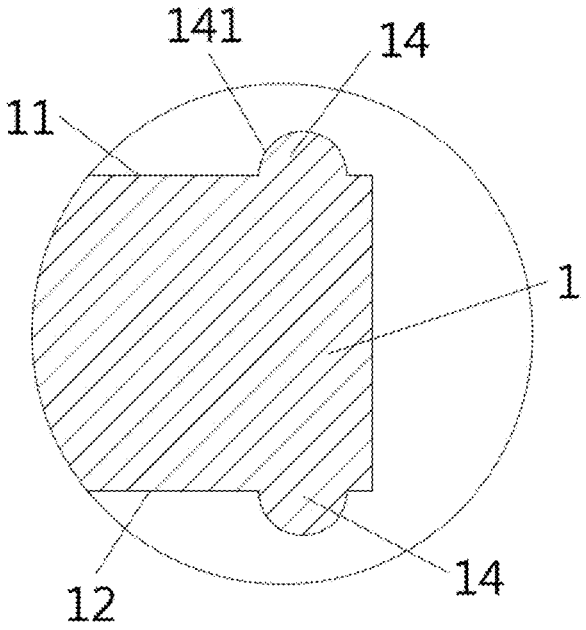
FIG. 3 is a partially enlarged schematic view of a ceramic body according to the second embodiment of the invention.
Figure 4:
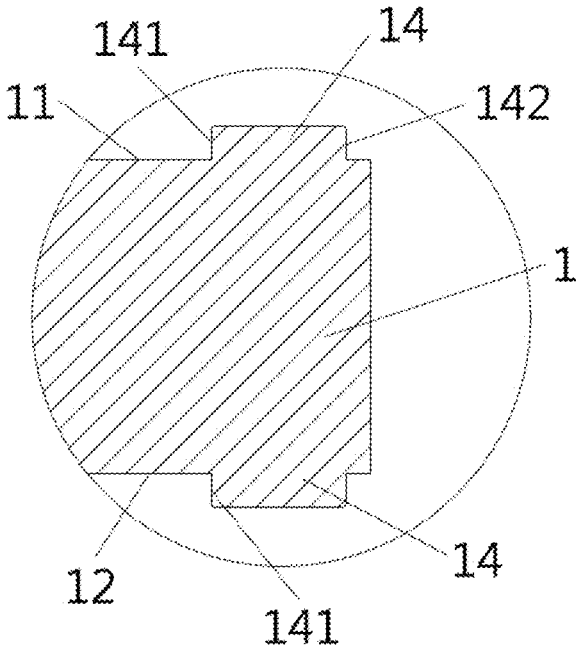
FIG. 4 is a partially enlarged schematic view of a ceramic body according to the third embodiment of the invention.

FIG. 1 and FIG. 2 are perspective view and partially enlarged schematic view of a ceramic body according to a first embodiment of the invention, respectively. As shown, the voltage dependent resistor includes a ceramic body 1 and a conductive structure for external connection. The ceramic body 1 includes two opposite surfaces 11, 12 and a side surface 13 connecting the two surfaces 11, 12. At least one of the surfaces 11, 12 is formed with at least one protrusion 14 at a position adjacent to the side surface 13, and the protrusion 14 is protruded from the surfaces 11, 12 by a height of 0.01 mm to 1 mm. According to the embodiment shown in the drawings, the surfaces 11 and 12 of the ceramic body 1 are both provided with protrusions 14, and each of the protrusions 14 is formed at its both sides with connection surfaces 141, 142 connected to the surface 11 or 12 of the ceramic body 1. The connection surfaces 141, 142 may be planar in shape and inclined towards inner and outer sides of the protrusion 14 at an inclination angle between 10 and 90 degrees. Alternatively, the connection surfaces 141, 142 may be configured in an arcuate form as shown in FIG. 3. Still alternatively, the connection surfaces 141, 142 may be planar in shape and substantially perpendicular to the surface 11, 12, as shown in FIG. 4. While the connection surfaces 141 and 142 are shown in the embodiments above to have the same configuration, they may be configured into different configurations. For instance, they may be configured in planar configurations inclined at different angles, or one of them is configured in planar form with the other being arcuate in shape.

Figure 5:
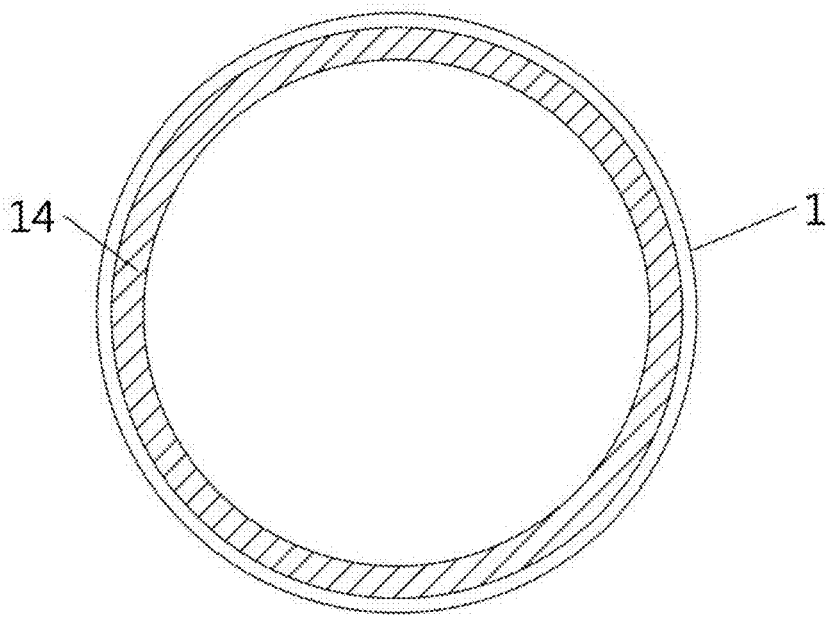
FIG. 5 is a partially enlarged schematic top view of a ceramic body according to the fourth embodiment of the invention.
Figure 6:
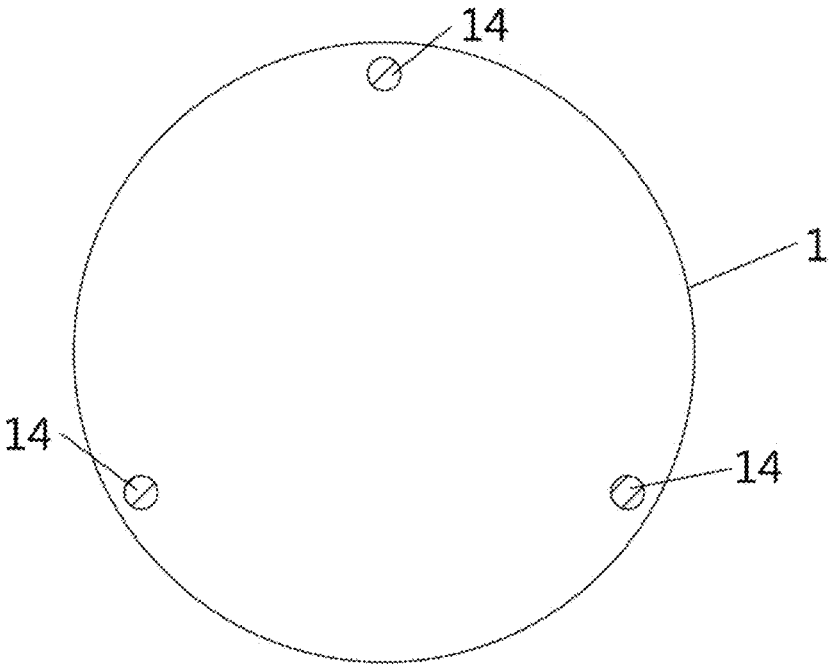
FIG. 6 is a schematic top view of a ceramic body according to the fifth embodiment of the invention.
Figure 7:
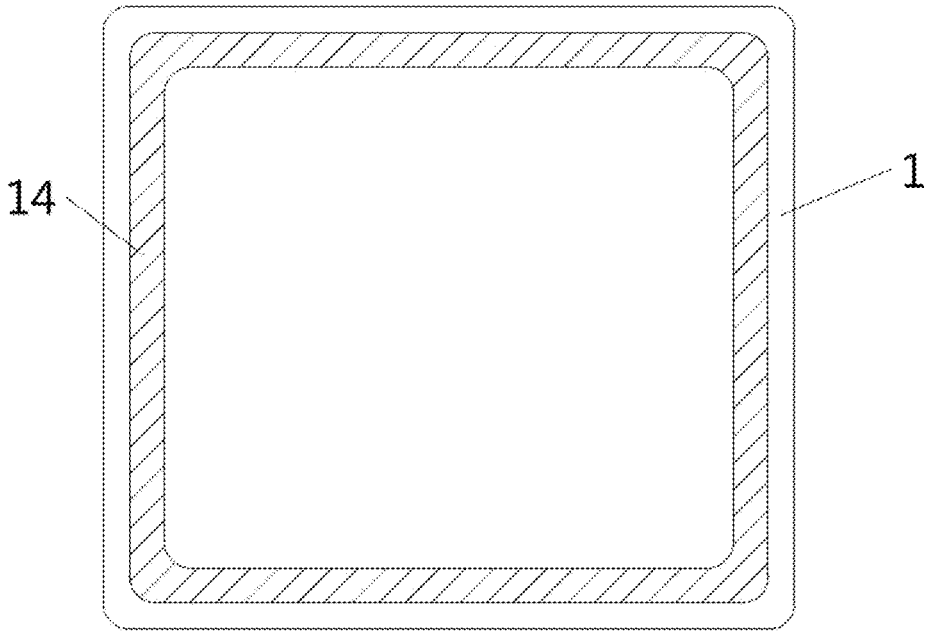
FIG. 7 is a schematic top view of a ceramic body according to the sixth embodiment of the invention.

According to the fourth embodiment shown in FIG. 5, at least one of the surfaces 11, 12 of the ceramic body 1 may be formed with a protrusion 14, and the protrusion 14 is configured in a closed annular loop extending along the side surface 13. The ceramic body 1 may be in a disc form, and the protrusion 14 may be configured into a circular configuration. Alternatively, according to the fifth embodiment shown in FIG. 6, the surfaces 11, 12 of the ceramic body 1 may be formed with three separate protrusions 14 circumferentially and symmetrically distributed on the surfaces 11 or 12 of the ceramic body 1 and spaced out at an equal angle apart. In other words, the three protrusions 14 are spaced out 120 degrees apart, when the ceramic body 1 is viewed from the top. In the fourth and fifth embodiments described above, the ceramic body 1 and the protrusion 14 may be, by way of example, configured in a circular form, when the ceramic body 1 is viewed from the top. Alternatively, the ceramic body 1 and the protrusion 14 may be in a rectangular shape according to the sixth embodiment shown in FIG. 7.

Figure 8:
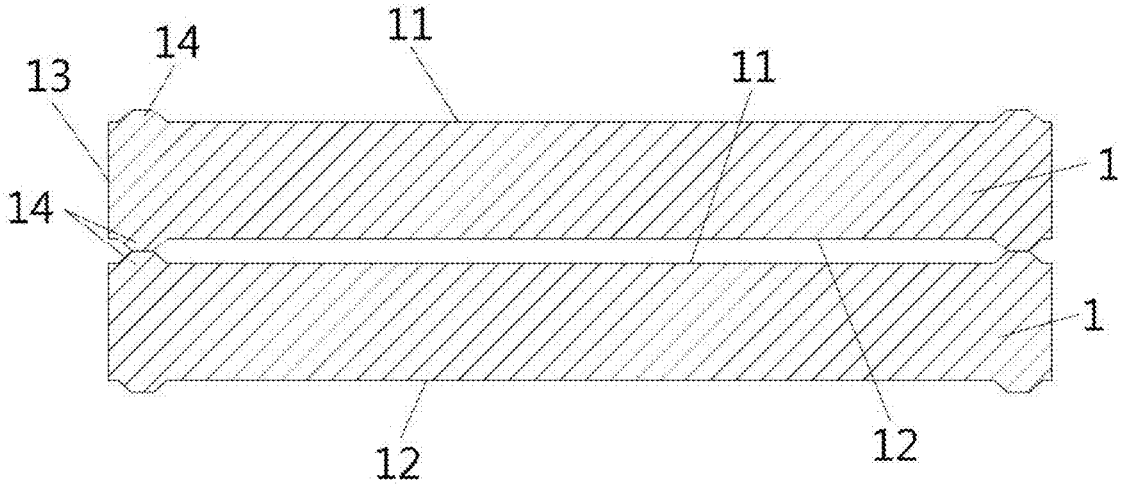
FIG. 8 is a schematic view of the ceramic bodies according to the invention being stacked during the manufacturing process.

According to the invention, since the protrusion 14 is formed on at least one of the surfaces 11, 12 of the ceramic body 1, it makes the surfaces 11, 12 non-planar, as shown in FIG. 8. Such non-planar configuration tends to prevent ceramic plates from adhering with each other when they are stacked with each other during the sintering of a green compact, thereby simplifying the post-processing procedures and minimizing the defect rate.

Figure 9:
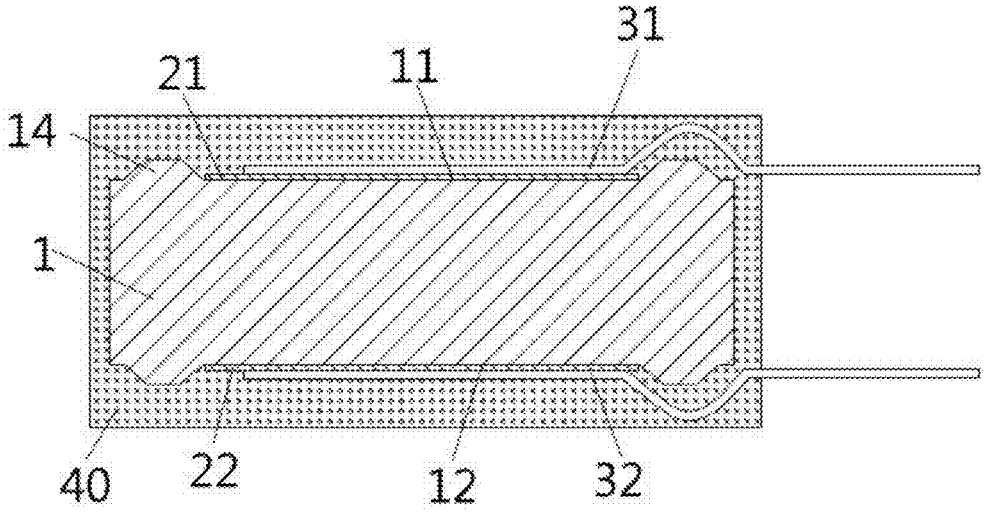
FIG. 9 is a schematic view of a voltage dependent resistor according to the invention.

The ceramic body 1 according to the invention is adapted to be combined with an electrically conductive structure to constitute a voltage dependent resistor. As shown in FIG. 9, the conductive structure may include a first electrode 21 and a second electrode 22, and a first terminal 31 and a second terminal 32. The first and second electrodes 21, 22 are disposed on the surfaces 11, 12, respectively. The first terminal 31 is disposed at one end thereof on the ceramic body 1 in such manner that it is electrically connected to the first electrode 21, whereas the other end of the first terminal 31 extends beyond the ceramic body 1. The second terminal 32 is disposed at one end thereof on the ceramic body 1 in such manner that it is electrically connected to the second electrode 22, whereas the other end of the second terminal 32 extends beyond the ceramic body 1. The first and second terminals 31, 32 form an arcuate configuration along the protrusions 14, respectively. The voltage dependent resistor may be further coated with an insulating layer 40, so that the first and second electrodes 21, 22, as well as the one ends of the first and second terminals 31, 32, are embedded. The first and second electrodes 21, 22, the first and second terminals 31, 32, and the insulating layer 40 are made of materials known in the art, which are thus not described herein.

According to the invention, the at least one protrusion is configured to protrude from the surface of the ceramic body and reside close to the side surface of the ceramic body. By virtue of such structural arrangement, the voltage dependent resistor incorporated with the ceramic body is capable of suppressing the flashover firelight effect of the first and second electrodes on the side surface of the ceramic body and the insulating layer during a surge impact. As a result, the voltage dependent resistor is improved in terms of its capability of withstanding surge impact and its lifespan.

In summary, the invention provides a preferred and feasible voltage dependent resistor. While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A voltage dependent resistor comprising:

a ceramic body comprising two opposite surfaces and a side surface connecting the two opposite surfaces, wherein at least one of the two opposite surfaces is formed with at least one protrusion at a position adjacent to the side surface; and an electrically conductive structure electrically connected to the ceramic body and adapted for external connection, wherein the electrically conductive structure comprises a first electrode and a second electrode, which are disposed on the at least one of the two opposite surfaces without covering the at least one protrusion, so that the at least one protrusion is arranged to protrude beyond the first electrode and the second electrode.

2. The voltage dependent resistor according to claim 1, wherein at least one of the opposite surfaces of the ceramic body is formed with a protrusion configured in an annular closed loop extending along the side surface.

3. The voltage dependent resistor according to claim 1, wherein at least one of the opposite surfaces of the ceramic body is formed with three protrusions.

4. The voltage dependent resistor according to claim 3, wherein the three protrusions are circumferentially and symmetrically distributed on the at least one of the opposite surfaces of the ceramic body and spaced out 120 degrees apart, when the ceramic body is viewed from top.

5. The voltage dependent resistor according to claim 2, wherein the electrically conductive structure comprises a first terminal and a second terminal, wherein the first terminal is disposed at one end thereof on the ceramic body in such manner that it is electrically connected to the first electrode, while the other end of the first terminal extends beyond the ceramic body, and wherein the second terminal is disposed at one end thereof on the ceramic body in such manner that it is electrically connected to the second electrode, while the other end of the second terminal extends beyond the ceramic body.

6. The voltage dependent resistor according to claim 5, further comprising an insulating layer coated outside of the ceramic body, so that the first and second electrodes and the one ends of the first and second terminals are embedded.

7. The voltage dependent resistor according to claim 2, wherein the at least one protrusion has connection surfaces connected to the ceramic body.

8. The voltage dependent resistor according to claim 7, wherein the connection surfaces are independently configured into a form selected from the group consisting of a planar form and an arcuate form.

9. The voltage dependent resistor according to claim 7, wherein the connection surfaces are inclined with respect to the opposite surfaces.

10. The voltage dependent resistor according to claim 7, wherein the connection surfaces are arranged substantially perpendicular to the opposite surfaces.

11. The voltage dependent resistor according to claim 4, wherein the electrically conductive structure comprises a first terminal and a second terminal, wherein the first terminal is disposed at one end thereof on the ceramic body in such manner that it is electrically connected to the first electrode, while the other end of the first terminal extends beyond the ceramic body, and wherein the second terminal is disposed at one end thereof on the ceramic body in such manner that it is electrically connected to the second electrode, while the other end of the second terminal extends beyond the ceramic body.

12. The voltage dependent resistor according to claim 11, further comprising an insulating layer coated outside of the ceramic body, so that the first and second electrodes and the one ends of the first and second terminals are embedded.

13. The voltage dependent resistor according to claim 4, wherein the at least one protrusion has connection surfaces connected to the ceramic body.

14. The voltage dependent resistor according to claim 13, wherein the connection surfaces are independently configured in a planar or an arcuate form.

15. The voltage dependent resistor according to claim 13, wherein the connection surfaces are inclined with respect to the opposite surfaces.

16. The voltage dependent resistor according to claim 13, wherein the connection surfaces are arranged substantially perpendicular to the opposite surfaces.

* * * * *